US006554715B1

(12) United States Patent
Gernstein

(10) Patent No.: US 6,554,715 B1
(45) Date of Patent: Apr. 29, 2003

(54) STEP FOR A WATER SLIDE OR THE LIKE

(76) Inventor: Dan H. Gernstein, 16572 Hascall St., Omaha, NE (US) 68130

( * ) Notice: Subject to any disclaimer, the term of this patent is extended or adjusted under 35 U.S.C. 154(b) by 0 days.

(21) Appl. No.: 10/162,095

(22) Filed: Jun. 3, 2002

(51) Int. Cl.[7] ..... A63G 21/18
(52) U.S. Cl. ..... 472/117
(58) Field of Search ..... 472/116, 117, 472/128, 136, 137; 52/182, 188, 187; 104/69, 70

(56) References Cited

U.S. PATENT DOCUMENTS

| | | | | |
|---|---|---|---|---|
| 4,194,733 A | | 3/1980 | Whitehouse, Jr. | |
| 5,137,497 A | * | 8/1992 | Dubeta | 472/88 |
| 5,543,198 A | | 8/1996 | Wilson | |
| 5,644,873 A | * | 7/1997 | Bourgault | 52/182 |
| 5,645,912 A | * | 7/1997 | Nelson et al. | 428/67 |
| 5,794,391 A | * | 8/1998 | Howard | 52/182 |
| 6,267,838 B1 | | 3/2001 | Saugnac et al. | |
| 6,372,322 B1 | | 4/2002 | Devaguptapu | |

FOREIGN PATENT DOCUMENTS

JP 2001047535 * 8/1999

OTHER PUBLICATIONS

Nida–Core Corporation brochure regarding Polypropylene Honeycomb: The New Heart and Core of Composites, undated.

Nida–Core "flyer" entitled "Light . . . Tough . . . Quiet", undated.

Misc. pages from the Nida–Core web site regarding "Superior Honeycomb Composite Materials," printed May 4, 2002.

Document entitled "Core Material Comparisons" prepared by Intermarine Yachting and dated Jan. 30, 1998.

Brochure entitled "Nida–Core Info", vol. 1.1, undated.

* cited by examiner

*Primary Examiner*—Kien T. Nguyen
(74) *Attorney, Agent, or Firm*—Thomte, Mazour & Niebergall; Dennis L. Thomte

(57) ABSTRACT

A fiberglass step for a water slide comprising a horizontally disposed tread and a vertically disposed riser. The tread of the step comprises vertically spaced-apart members which define a space therebetween having a polypropylene honeycomb material positioned therebetween. The steps are positioned between step supports and are secured thereto.

7 Claims, 3 Drawing Sheets

STEP FOR A WATER SLIDE OR THE LIKE

BACKGROUND OF THE INVENTION

1. Field of the Invention

This invention relates to a step for a water slide or the like and more particularly to a step for a water slide which is comprised of a fiberglass material having a plastic honeycomb core provided therein.

2. Description of the Related Art

Water slides have become increasingly popular during the last several years. Water slides which are found in amusement parks normally include a steel framework having a slide secured thereto which extends from the upper end of the framework downwardly to a splash pool or the like. Persons using the water slide normally move to the top of the slide by a series of steps which may be comprised of metal or wood. If the steps are comprised of metal, they tend to rust over a period of time since they are constantly exposed to water. If the steps are comprised of wood, the steps, even though treated, will rot over a period of time. It is also important that the steps be very strong since more than one person may be standing on a particular step at one time.

SUMMARY OF THE INVENTION

A step for a water slide or the like is disclosed wherein the water slide includes a framework having a slide secured thereto which has upper and lower ends. The framework also includes a pair of upstanding step supports which are horizontally spaced-apart, each of which have inner and outer surfaces and upper and lower ends. A plurality of steps are secured to the step supports and extend therebetween. The steps are comprised of a fiberglass material. Each of the steps includes a horizontally disposed tread having upper and lower members which are spaced-apart to define a space therebetween with that space being filled with a polypropylene honeycomb material. Each of the steps also includes a vertically disposed riser which extends upwardly from the tread.

It is therefore a principal object of the invention to provide an improved step for a water slide or the like.

A further object of the invention is to provide a step for a water slide or the like wherein the tread of the step includes upper and lower fiberglass members which define a space therebetween and which is filled with a plastic honeycomb material.

Still another object of the invention is to provide a step for a water slide or the like which is extremely strong.

Still another object of the invention is to provide a step for a water slide or the like which will not rust or rot.

Still another object of the invention is to provide a fiberglass step for a water slide or the like wherein the top surface of the tread has anti-slip material provided thereon.

Still another object of the invention is to provide fiberglass step for a water slide or the like wherein the upper surface thereof has channels formed therein for permitting the drainage of water from the step.

These and other objects will be obvious to those skilled in the art.

DESCRIPTION OF THE PREFERRED EMBODIMENT

Figure 1:
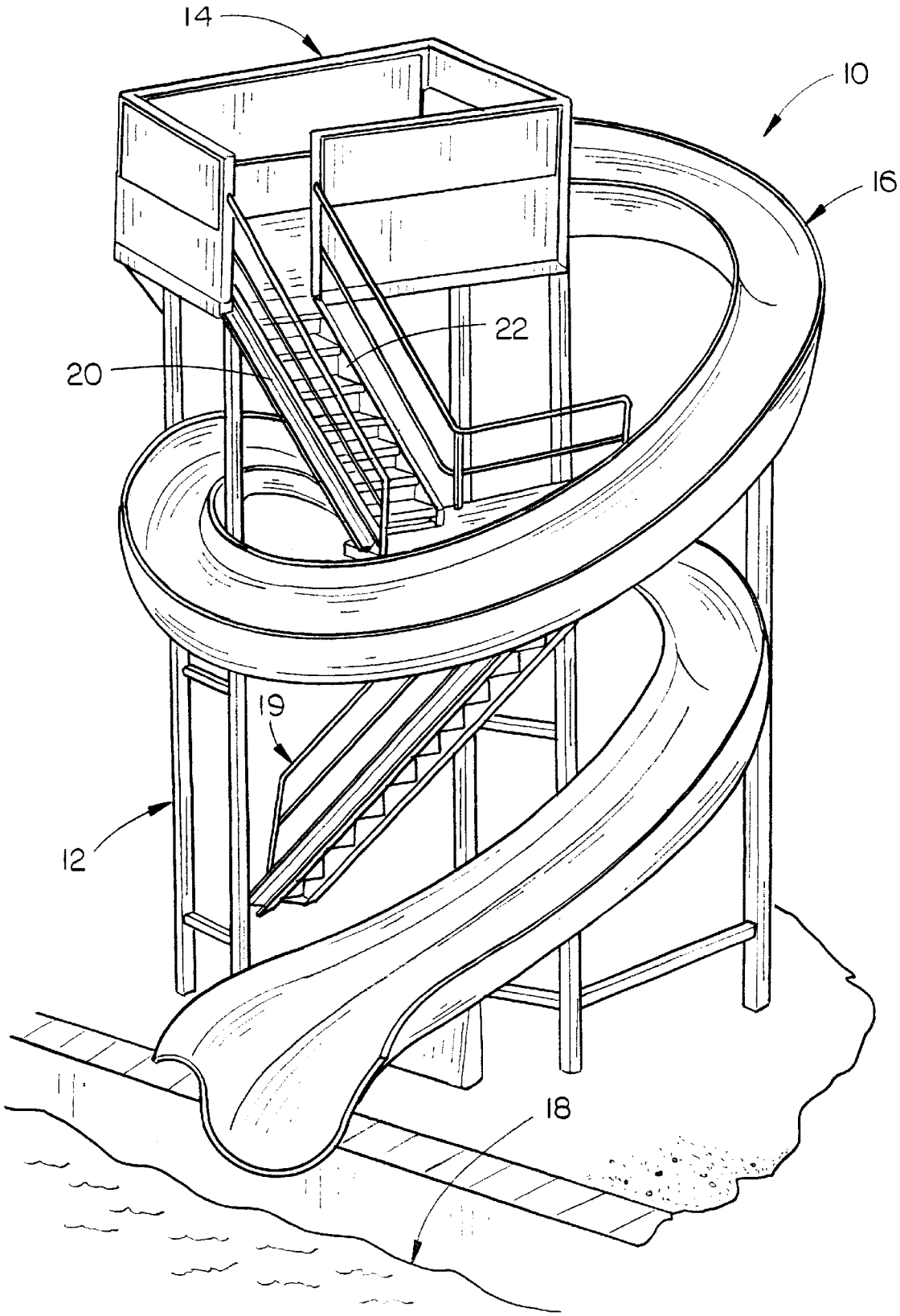
FIG. 1 is a perspective view of a water slide having the steps of this invention provided thereon.
Figure 2:
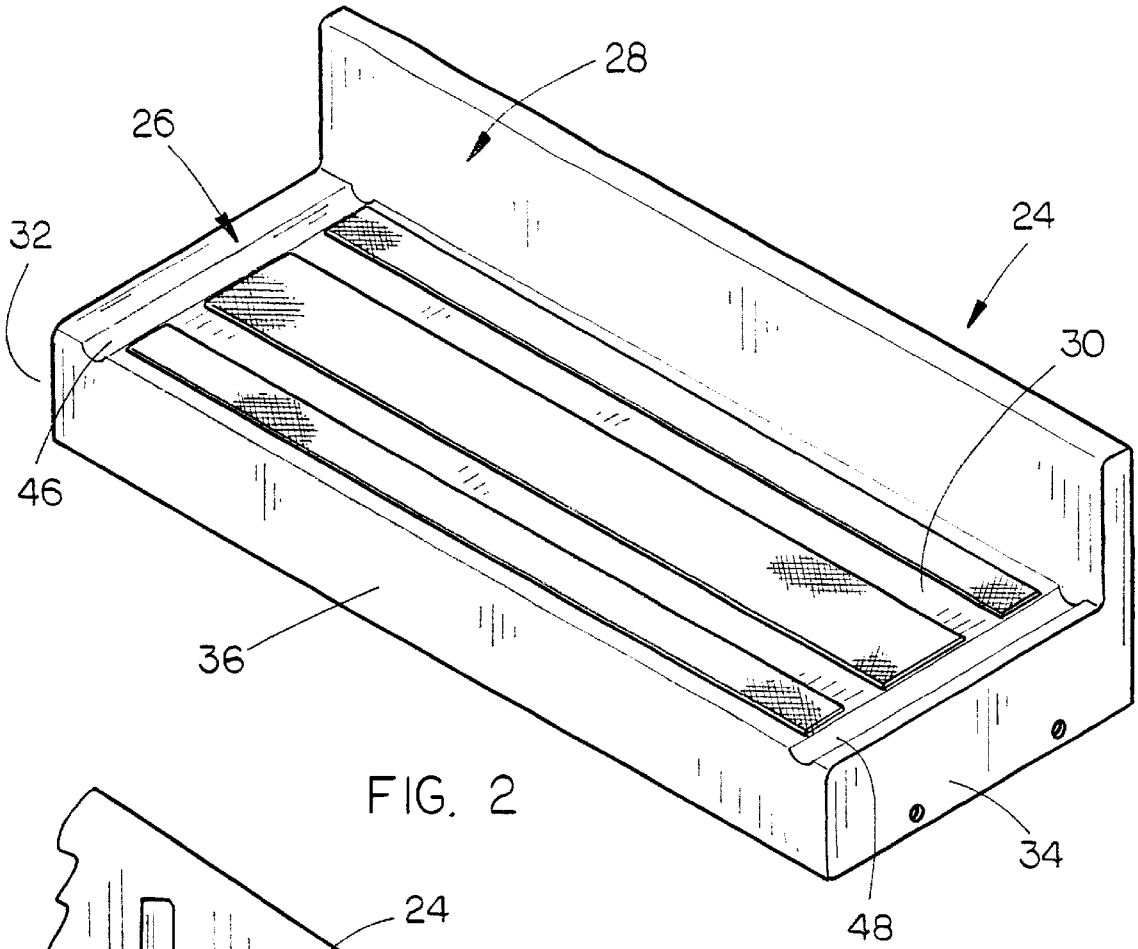
FIG. 2 is a perspective view of the step of this invention.

The numeral 10 refers generally to a water slide such as commonly found in an amusement park. Although the step invention which will be described hereinafter is well-suited for use with large water slides such as found in amusement parks, the step of this invention may be used on any water slide, regardless of size.

Slide 10 includes a framework 12 which is normally comprised of a metal material such as steel but which may also be comprised of a wood material in some cases. Platform 14 is provided at the upper end of the framework 12 to enable the persons utilizing the slide to gain access to the upper end of the slide member 16 which extends downwardly from the platform 14 to a splash pool or the like referred to generally by the reference numeral 18.

Figure 4:
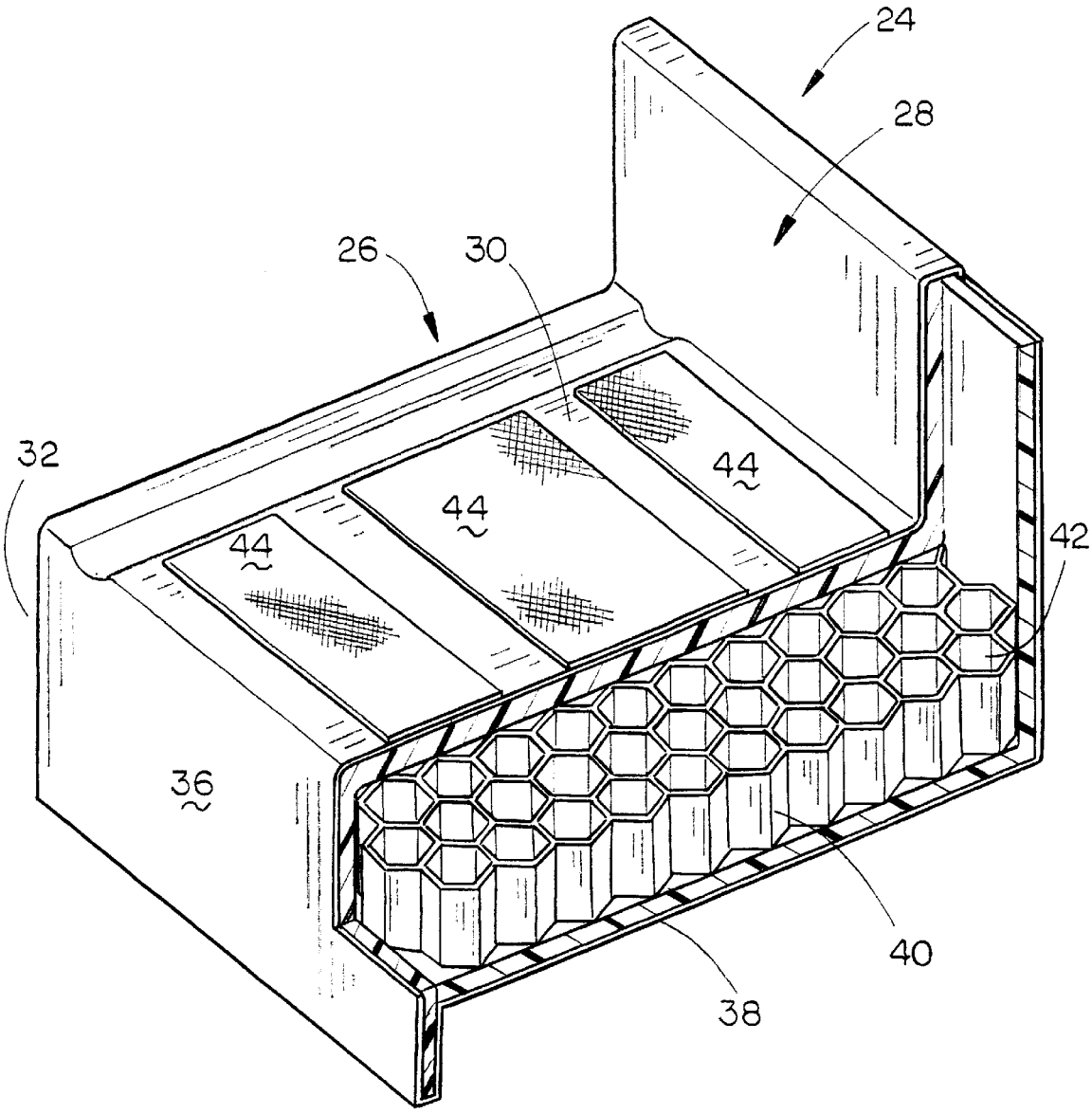
FIG. 4 is a partial perspective view of the step of this invention with portions thereof cut away to more fully illustrate the invention.

To enable the persons using the slide to move from ground level to the platform 14, a step assembly is provided which is referred to generally by the reference numeral 19. Normally, the step assembly will include horizontally spaced-apart metal step supports 20 and 22 which are normally comprised of steel. Normally, metal or wooden steps are secured to the supports 20 and 22 and extend therebetween. Inasmuch as the conventional metal steps tend to rust over time, and in as much as the wooden steps tend to rot over time, applicant has designed a fiberglass step which is referred to generally by the reference numeral 24. Step 24 generally includes a tread 26 and riser 28 which are integrally formed. For purposes of description, tread 26 will be described as having a top member 30, sides 32 and 34, front 36 and bottom member 38. Top member 30 and bottom member 38 are spaced-apart to define a space therebetween is which is filled with a plastic honeycomb material referred to generally by the reference numeral 40. Honeycomb material 40 is comprised of a plurality of individual cells 42, the longitudinal axes of which are vertically disposed, as best seen in FIG. 4. Preferably, the honeycomb material 40 is comprised of polypropylene such as sold under the trademark "Nida-Core" by Nida-Core Corporation, 541 NW Interpark Place, Port St. Lucie, Fla. 34986. The polypropylene honeycomb material, as opposed to paper honeycomb material, does not deteriorate or delaminate when exposed to water. The honeycomb material 40 adds great strength to the step so that the step may support more than one person thereupon.

Preferably, the upper surface of upper member 30 is provided with anti-slip material 44 to provide secure footing for the people using the slide. Also, the upper surface of member 30 is preferably provided with a pair of channels 46 and 48 formed therein which serve to drain water from the top surface of member 30.

Figure 3:
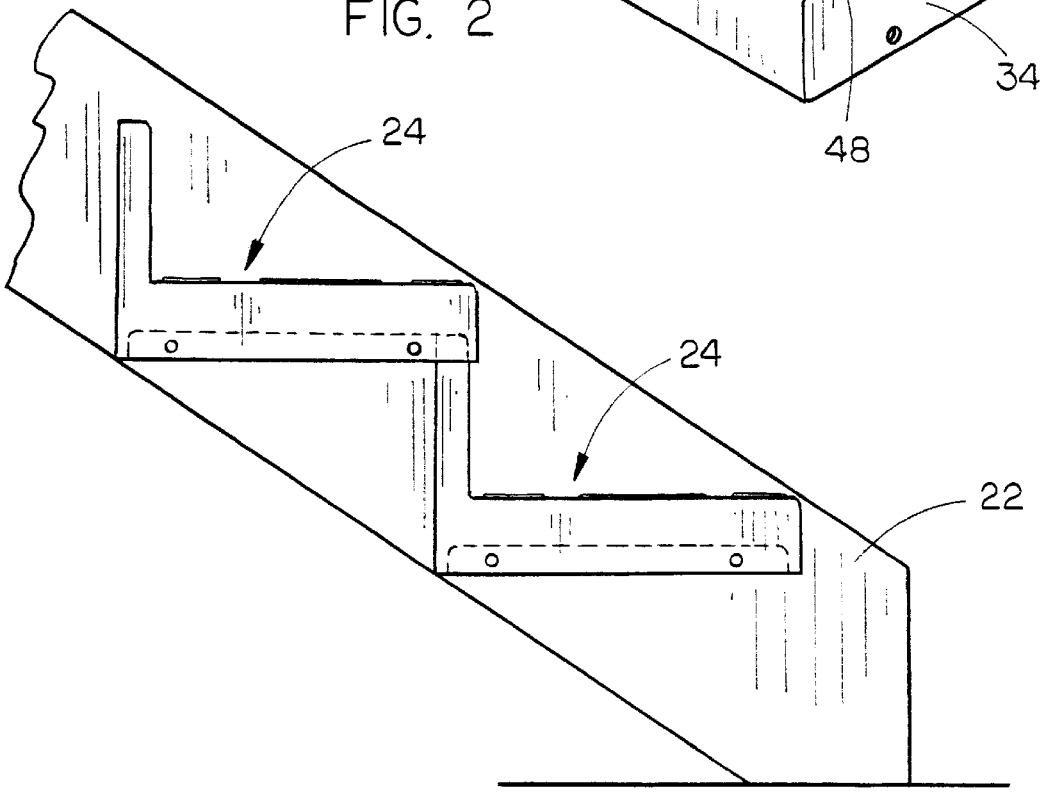
FIG. 3 is a side elevational view of the steps of this invention.

The steps 24 are secured to the supports 20 and 22 by extending screws, bolts, or the like, through the supports 20 and 22 and into the sides 32 and 34 of the step or vice versa. Preferably, the steps are arranged as seen in FIG. 3. As seen in FIG. 3, the upper end of the riser 28 is received by the underside of the step immediately thereabove.

Thus it can be seen that a novel fiberglass step has been provided for a water slide or the like which will not rust or rot and will have great strength due to the polypropylene honeycomb material provided therein.

Thus, it can be seen that the invention accomplishes at least all of its stated objectives.

I claim:

1. In combination with a water slide including a framework having a slide secured thereto having upper and lower ends, the framework also including at least a pair of upstanding step supports which are horizontally spaced-apart, each of which have inner and outer surfaces and upper and lower ends, comprising:

a plurality of steps secured to said step supports and extending therebetween;

said steps including a horizontally disposed tread having upper and lower members which are spaced-apart to define a space therebetween and wherein said space is filled with a plastic honeycomb material;

said steps including a riser having an upper end wherein the upper ends of said risers are positioned closely adjacent to the lower member of the tread of the step positioned thereabove;

said steps being comprised of a fiberglass material.

2. The combination of claim 1 wherein said plastic honeycomb material is comprised of polypropylene.

3. The combination of claim 1 wherein said plastic honeycomb material is Nida-Core™.

4. The combination of claim 1 wherein said plastic honeycomb material comprises a plurality of elongated hollow cells having substantially vertically disposed longitudinal axes.

5. The combination of claim 1 wherein said upper members have an upper surface and wherein a non-slip material is positioned on said upper surface.

6. The combination of claim 5 wherein said upper surface has drainage channels formed therein.

7. The combination of claim 1 wherein said steps each have opposite side walls and a front wall and wherein said lower members of said steps are positioned above the lower ends of said side walls and said front wall and wherein the upper ends of the risers are positioned closely adjacent to the lower member between said side walls and said front wall.

* * * * *